US006394331B1

(12) United States Patent
Haider

(10) Patent No.: US 6,394,331 B1
(45) Date of Patent: May 28, 2002

(54) DEVICE AND PROCESS FOR SEPARATING AND TRANSFERRING A LEADER STRIP

(75) Inventor: Peter Haider, St. Pölten (AT)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/589,275

(22) Filed: Jun. 8, 2000

(30) Foreign Application Priority Data

Jun. 29, 1999 (DE) ..... 199 29 927

(51) Int. Cl.[7] ..... G03B 1/56; D21J 1/02; B26D 3/00

(52) U.S. Cl. ..... 226/91; 162/194; 162/286; 226/97.3

(58) Field of Search ..... 226/91, 92, 97.3; 162/194, 286

(56) References Cited

U.S. PATENT DOCUMENTS

| | | | | | |
|---|---|---|---|---|---|
| 3,143,016 | A | * | 8/1964 | Obenshain | 226/97.3 X |
| 3,355,349 | A | * | 11/1967 | Devlin | 226/92 X |
| 3,999,696 | A | * | 12/1976 | Reba et al. | 226/91 X |
| 4,501,643 | A | | 2/1985 | Kiuru | |
| 4,505,412 | A | * | 3/1985 | Reba | 226/97.3 X |
| 4,542,842 | A | * | 9/1985 | Reba | 226/97.3 X |
| 4,684,443 | A | * | 8/1987 | Kerttula et al. | 162/286 X |
| 4,904,344 | A | | 2/1990 | Pieffer | |
| 4,923,567 | A | | 5/1990 | Liedes et al. | |
| 5,205,504 | A | * | 4/1993 | Kusafuka et al. | 226/92 |
| 5,413,017 | A | | 5/1995 | Mah | |
| 5,600,897 | A | * | 2/1997 | Sollinger et al. | 34/115 |
| 6,073,825 | A | * | 6/2000 | Hilker | 226/91 |

FOREIGN PATENT DOCUMENTS

| | | |
|---|---|---|
| CA | 2144623 | 9/1995 |
| DE | 3924897 | 2/1991 |
| DE | 3941242 | 6/1991 |
| DE | 4409660 | 8/1994 |
| DE | 19713540 | 10/1998 |
| DE | 19747835 | 4/1999 |
| EP | 554339 | 8/1994 |

* cited by examiner

*Primary Examiner*—Michael R. Mansen
(74) *Attorney, Agent, or Firm*—Greenblum & Bernstein, P.L.C.

(57) ABSTRACT

Apparatus and process for separating and transferring a leader strip to be threaded into a machine for at least one of producing and treating a material web. The apparatus includes a separating device positioned to perform a separation process, a transfer device positioned to transfer the leader strip to a subsequent device of the machine after the separation process, and a common plate positioned to guide the transfer strip prior to the separation process. The transfer device is positioned upstream, relative to a strip travel direction, from the separating device. The process includes guiding a transfer strip over a common plate, separating the transfer strip with a separating device, and transferring the transfer strip to a subsequent device of the machine after the separating with a transfer device. The transfer device is positioned upstream, relative to a strip travel direction, from the separating device.

41 Claims, 2 Drawing Sheets

DEVICE AND PROCESS FOR SEPARATING AND TRANSFERRING A LEADER STRIP

CROSS-REFERENCE TO RELATED APPLICATIONS

The present application claims priority under 35 U.S.C. §119 of German Patent Application No. 199 29 927.7, filed on Jun. 29, 1999, the disclosure of which is expressly incorporated by reference herein in its entirety.

BACKGROUND OF THE INVENTION

1. Field of the Invention

The invention relates to a device for separating and transferring a leader strip to be threaded into a machine for producing and/or treating a material web, in particular a paper or cardboard web, having a separating device and a transfer device that is used to transfer the leader strip into a subsequent device of the machine after a successful separation.

2. Discussion of Background Information

Such a device can be used, for example, to thread a paper web into a paper machine. As a rule, it is impossible to thread the entire width of the material web because of the large web widths. Therefore, a leader strip, which is threaded into the paper machine and subsequently pulls the entire width of the paper web after it, is cut from the web. The threading process occurs during startup of the paper machine or after a web tear. The device mentioned can be used practically at any given point in the paper machine, e.g., at the end of the dryer section or between a smoothing machine and a winding device.

In a device of the type mentioned at the outset that is known from DE 44 09 660 A1, the leader strip is separated in that a guide panel mounted in a pivoted manner on a doctor bar is pivoted with its free end along a separating edge past a further guide panel. Thus, the strip separation occurs between two guide panels, at least one of which must be mounted in a pivoted manner.

In a further separating and transferring device known from DE 39 24 897 A1, the leader strip is separated in a channel formed between two guide panels by means of a water jet cutter. At least one of the two guide panels is pivotable here as well.

In a separating and transferring device described in U.S. Pat. No. 4,923,567, the leader strip is separated by means of an air or water jet cutter. The leader strip is subsequently deflected to a guide panel arranged before the separating device in the strip travel direction which is tangentially loaded by a jet of air in order to continue to guide the web along this panel.

In a separating device known from EP 0 554 339 B1, the strip separation is performed by means of two knives rotating in opposite directions. The leader strip is guided to these rotating knives by means of a pivotable guide panel. The separating device that includes the rotating knives can be pivotable into the region of a vacuum belt, which further transports the leader strip after the separation process. After each separation process, the separating device is again pivoted away from the vacuum belt.

SUMMARY OF THE INVENTION

The object of the invention is to create a device of the type mentioned at the outset which can not only be produced in a cost-effective manner, but also has a relatively compact construction and, in particular, can be easily integrated, for example, into a pre-existing dryer section. Furthermore, it should be useable in new and in renovated plants in the simplest way possible.

This object is attained according to the invention in that the separating device and the transfer device are preferably attached to a common plate upon which the leader strip is guided before separation and can be pre-stressed before the separation process and in that the transfer device is arranged before the separating device in the strip travel direction (L).

This design results in a construction for the entire device that is extremely simple and compact overall. Not only can the device be produced in a cost-effective manner, it can also be integrated in a trouble-free manner, in particular into a preexisting drying section. With the solution according to the invention, a greater flexibility is also achieved in view of the possible applications. Thus, the device according to the invention can be used in a trouble-free manner in renovated as well as new installations.

The plate is preferably firmly attachable to a doctor bar. Thus, pivoting the plate is no longer necessary.

In a preferred practical embodiment of the device according to the invention, the transfer device is formed by an air transfer device.

In order to stabilize the leader strip before the separation process, the side of the plate facing the leader strip can be at least essentially tangentially loaded with an appropriate jet of pressurized air.

In a suitable practical embodiment, at least one air guide panel is provided following the separating device on the side of the plate facing the leader strip for the purpose of pre-stressing the leader strip in the strip travel direction. The air guide panel is preferably inclined relative to the surface of the plate facing the leader strip in such a way that the leader strip is lifted from this plate surface and appropriately guided through the separating region of the separating device. This ensures that the leader strip can subsequently be separated in a reliable manner. More suitably, at least two guide panels are provided that are arranged one behind the other in the strip travel direction.

In a suitable practical embodiment, the transfer device provided as an air transfer device has several air nozzles. These nozzles can be adjustable and appropriately moveable.

It is also advantageous for the air transfer device to have an air blast pipe that includes at least one row of air nozzles extending parallel to the pipe axis. At least some of the air nozzles can be adjustable or moveable relative to the air blast pipe. Alternately or additionally, the air blast pipe can be adjustable and rotatable around its axis.

The jet of pressurized air that is necessary for stabilizing and/or pre-stressing the leader strip can advantageously be produced by means of adjustable air nozzles of the air transfer device, where the leader strip should preferably be pre-stressed. In principle, however, it is also conceivable to provide separate air nozzles for this kind of stabilization and pre-stressing.

In particular, the separating device can be designed for performing a scissor cut and/or a parallel cut.

In a suitable practical embodiment of the device according to the invention, the separating device has at least two cutting elements, particularly knife-like cutting elements, which are attached in an adjustable manner to two frame parts which are moveable relative to one another.

In a preferred practical embodiment, the two frame parts are pivotable relative to one another.

In certain cases, it can be advantageous for the separating elements of the separating device to be at least partially formed by smooth cutting elements. In principle, however, these separating elements can also be formed, at least in part, by perforated and/or toothed cutting elements.

The present invention is directed to an apparatus for separating and transferring a leader strip to be threaded into a machine for at least one of producing and treating a material web. The apparatus includes a separating device positioned to perform a separation process, a transfer device positioned to transfer the leader strip to a subsequent device of the machine after the separation process, and a common plate positioned to guide the transfer strip prior to the separation process. The transfer device is positioned upstream, relative to a strip travel direction, from the separating device.

According to a facet of the instant invention, the separating device and the transfer device can be coupled to the common plate. Further, at least one device can be arranged to pre-stress the leader strip prior to the separation process. The separation process can include separating the leader strip to form an end to be transferred to the subsequent device, and the material web can be one of a paper and a cardboard web. Moreover, the pre-stress device can be positioned downstream of the transfer device. The pre-stress device can also be positioned downstream of the separating device.

In accordance with a feature of the invention, a doctor bar may be provided, and the common plate can be firmly attached to a doctor bar.

In accordance with another feature of the present invention, the transfer device can include an air transfer device.

The transfer device may include at least one positionably adjustable nozzle. Prior to the separation process, the at least one nozzle can be positionable to direct a jet of air at least essentially tangentially to the common plate, thereby stabilizing the leader strip for separation.

Further, the transfer device may include at least one positionably adjustable nozzle. Prior to the separation process, the at least one nozzle may be positionable to direct a jet of air substantially along a leader strip carrying surface of the common plate, thereby stabilizing the leader strip for separation.

At least one air guide panel may be positioned downstream from the separating device and on a leader strip facing surface of the common plate. The at least one air guide panel can be arranged to pre-stress the leader strip prior to the separation process. The at least one air guide panel can be arranged to lift the leader strip off of the leader strip facing surface of the common plate. In this manner, the leader strip may be guided through a separating region of the separating device. Further, the at least one air guide panel can include at least two air guide panels positioned one behind the other in the strip travel direction.

In accordance with a further feature of the instant invention, the transfer device can include an air transfer device including several air nozzles. The air nozzles may be adjustable and moveable. The transfer device may include an air blast pipe with at least one row of air nozzles extending parallel to a tube axis. At least a portion of the air nozzles can be adjustable and moveable relative to the air blast pipe. The air blast pipe can also be adjustable and rotatable around the tube axis.

According to still another feature of the invention, the transfer device can include an air transfer device with positionably adjustable air nozzles. The adjustable air nozzles may be positionably adjustable to direct a jet of blown to at least one of stabilize and pre-stress the leader strip.

According to a still further feature of the present invention, the separating device may be arranged to produce at least one of a scissors cut and a parallel cut.

Moreover, the separating device can include at least two separating elements which are movable relative to each other. The at least two separating elements may be knife-like elements. Also, the at least two separating elements can be adjustably mounted on two frame parts that are movable relative to one another, and the two frame parts may be pivotably coupled to one another. The separating elements can be adjustably attached to the frame parts by set screws.

According to another facet of the present invention, the separating device can include separating elements which are at least partially constructed of smooth cutting elements.

In accordance with still another facet of the instant invention, the separating device can include separating elements which are at least partially constructed of at least one of perforated and toothed cutting elements.

The transfer device may include at least one positionably adjustable nozzle. Further, prior to the separation process, the at least one nozzle can be positionable to direct a jet of air to create a low pressure between the common plate and the leader strip, whereby the leader strip is guided against the common plate.

Further, a doctor can be located adjacent an element of the machine and positioned to remove the leader strip from the element. A surface of the doctor can face the leader strip is arranged to be substantially coplanar with the common plate.

The present invention is directed to a process for separating and transferring a leader strip to be threaded into a machine for at least one of producing and treating a material web. The process includes guiding a transfer strip over a common plate, separating the transfer strip with a separating device, and transferring the transfer strip to a subsequent device of the machine after the separating with a transfer device. The transfer device is positioned upstream, relative to a strip travel direction, from the separating device.

In accordance with a feature of the invention, the separating device and the transfer device can be coupled to the common plate. Further, the process can include pre-stressing the leader strip prior to separating. The separating can occur downstream of the transfer device. Still further, the process can include pre-stressing the leader strip prior to separating, and the separating may occur downstream of the separating device.

According to another feature of the invention, the process can also include directing a jet of air at least tangentially to the common plate, thereby stabilizing the leader strip for separation.

In accordance with still another feature of the present invention, the process can also include directing a jet of air substantially along a leader strip carrying surface of the common plate, thereby stabilizing the leader strip for separation.

Further, the process can include pre-stressing the leader strip prior to separating by directing an air jet obliquely to the strip travel direction.

According to yet another feature of the present invention, the process can include directing an air jet to press the leader strip against the common plate via the Coanda effect.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most usefull and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 2:
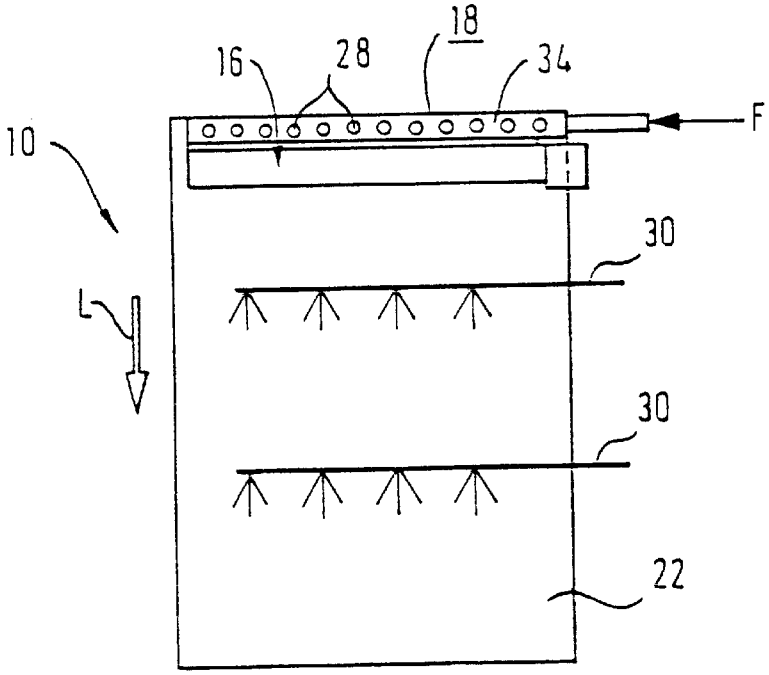
FIG. 2 a schematic front view of the separating and transferring device.
Figure 3:
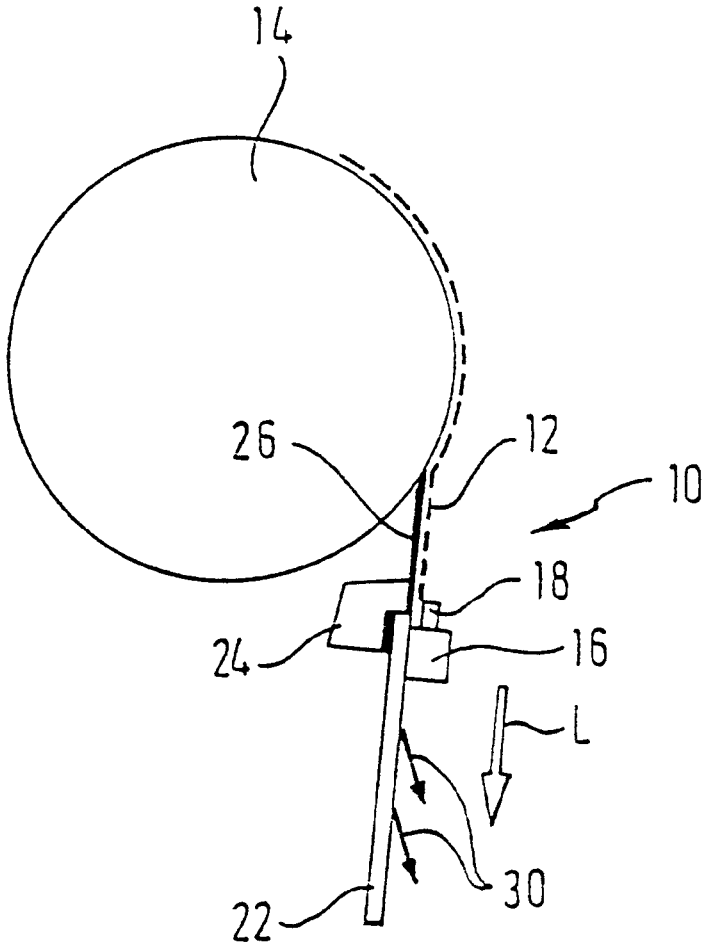
FIG. 3 a schematic side view of the separating and transferring device.

The device 10 shown schematically in FIGS. 2 and 3 serves to separate and transfer a leader strip 12 cut from a material web, which is to be threaded into a machine for producing and/or treating a material web. In the present case, the leader strip 12 is cut out of a paper web and the device 10 is arranged in the exit region of one of the drying cylinders 14 associated with the drying section of the applicable paper machine (see, in particular, FIG. 3).

The device 10 includes a separating device 16 (see also, in particular, FIG. 1) and a transfer device, in the present case, an air transfer device 18 that serves to transfer the leader strip 12 to a subsequent device of the paper machine once the leader strip has been successfully separated. In the present case, the leader strip 12 is guided over rope shears 20, which are formed by an inner rope 20' and an outer rope 20", which are appropriately moved towards one another (see FIG. 1).

The separating device 16 and the air transfer device 18 are attached to a common fixed plate 22 upon which the leader strip 12 is guided before separating and pre-stressed for the separation process.

As can be seen from FIG. 3, the plate 22 is firmly connected to a doctor bar 24. The doctor bar 24 carries a doctor 26, also referred to as a doctor blade, which serves to remove the paper web from the drying cylinder 14 at startup or in case of a web tear. During the normal production operation, the paper web has already left the drying cylinder 14 before the doctor 26, whereupon it is guided, in particular to a web guide roll or the like, in order to be guided thereby to a subsequent device such as, e.g., a stacked calender. During the threading process, a leader strip 12 is cut on one of the two edges of the paper web, e.g., by means of a pointed cutter. This strip is initially pulled away downwards over the doctor 26 and the plate 22 before the activation of the device 10.

As can be best seen in FIG. 2, the air transfer device 18 is arranged before the separating device 16 as seen in the strip travel direction L.

In order to stabilize the leader strip 12 before the separation process, the side of the plate 22 facing this leader strip 12 is loaded with an appropriate jet of air in an at least essentially tangential manner, which jet of air is produced, for example, by means of appropriately adjustable air nozzles 28 which, in the current embodiment, are provided in the region of the air transfer device 18 and may, for example, be assigned thereto. In principle, however, separate nozzles can also be provided to produce the jet of air to stabilize the leader strip 12.

The applicable jet of air presses against the side of the plate 22 facing the leader strip 12, following the side of the plate in the strip travel direction L as a result of the so-called Coanda effect. As a result of the air jet, an under pressure occurs on the underside of the leader strip 12 facing the plate 22 such that the leader strip is adhered to the plate 22 and thus is optimally guided thereby.

In order to pre-stress the leader strip 12, at least one air guide panel 30 is arranged behind the separating device 18 viewed in the strip travel direction L on the side of the plate 22 facing the leader strip 12. In the present case, two air guide panels arranged one behind the other in the strip travel direction L are provided.

Both air guide panels 30 extending crosswise to the strip travel direction L are inclined in relation to the plate surface facing the leader strip 12 in such a way that the leader strip 12 is lifted from this plate surface and appropriately fed through the separating region 32 (see FIG. 1) of the separating device 16. This ensures that the leader strip 12 is subsequently separated in a reliable manner.

The air transfer device 18 includes several air nozzles 28 that are adjustable in the present case and are appropriately moveable for this purpose. In the current exemplary embodiment, the air transfer device 18 includes an air blast pipe 34 having at least one row of air nozzles 28 extending parallel to the tube axis. Here, at least one part of the air nozzles 28 is adjustable and/or moveable relative to the air blast pipe 34. Additionally, the air blast pipe itself can be adjustable, i.e., rotatable around an axis, for example.

For each separation process, the air blast pipe 34 can, for example, be turned and the air nozzles 28 can be aligned in such a way that a jet of blown air results running parallel to the strip travel direction L for the purpose of stabilizing the leader strip 12. After a successful separation process, it is possible, for example, to turn the air blast pipe 34 and align the air nozzles 28 in such a way that the leader strip 12 is transferred laterally to the rope shears 20 (see FIG. 1).

The air blast pipe 34 is inserted laterally in the direction of the arrow F (see FIG. 2).

Fundamentally, while the jet of blown air necessary for stabilizing and/or pre-stressing the leader strip 12 is produced in the present case, for example, by way of appropriately adjustable air nozzles 28 of the air transfer device (blast pipe) 34, separate air nozzles can also be provided by this air transfer device 34 for the purpose of stabilizing and/or pre-stressing the leader strip 12.

The separating device 16 can optionally be designed to perform a scissor cut and/or a parallel cut.

Figure 1:
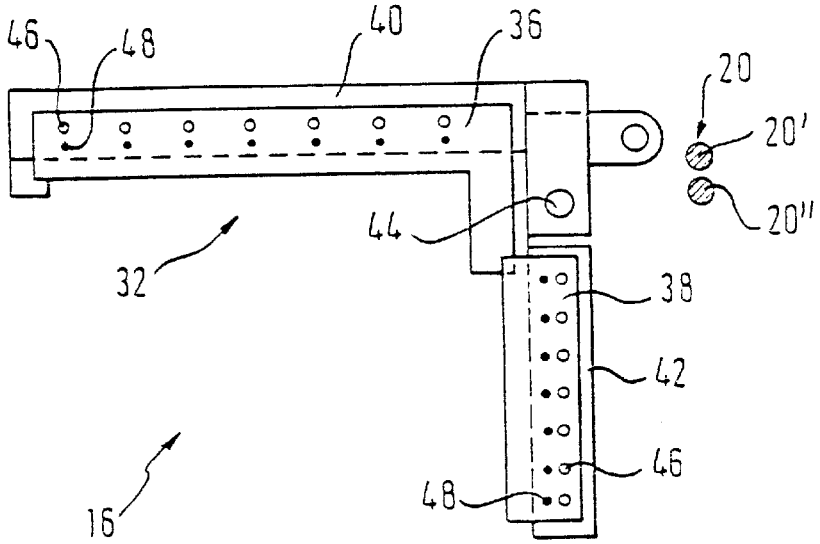
FIG. 1 a schematic depiction of the separating element of a device for separating and transferring a leader strip cut from a material web in its open position.

In the present exemplary embodiment, the separating device 16 includes two separating elements 36, 38, in particular knife-like separating elements, which are preferably attached in an adjustable manner to two frame parts 40, 42 which are moveable relative to one another (see, in particular, FIG. 1).

In the present exemplary embodiment, the two frame parts 40, 42 can be pivoted relative to one another around an axis 44. In the present case, the frame part 40 is firmly attached to the plate 22 (see FIGS. 2 and 3) while the other frame part 42 can be pivoted upwards toward the frame part 40 beginning from the open state shown in FIG. 1. For this purpose, an appropriate drive such as, for example, at least one cylinder/piston unit or the like, can be provided which can be controlled by means of a control unit as soon as the leader strip 12 is stabilized on the plate 22 and pre-stressed in the desired manner.

In the present case, the two knife-like separating elements 36, 38 are attached to the frame parts 40, 42 by means of set screws 46, 48 and/or the like.

The knife-like separating elements 36, 38 of the separating device 18 can be formed, for example, by smooth cutting elements or perforated and/or toothed cutting elements.

As soon as the leader strip 12 is stabilized and pre-stressed on the plate 22, the separating device 16 can be activated appropriately, in particular by means of a control device. Immediately after the separation process, the leader strip coming from the drying cylinder 14 is guided through the air transfer device 18 and then transferred to the rope shears 20.

Thus, a separating and transfer device results that can be produced in a cost-effective manner, is compact in its structure, and, in particular, can also be integrated into a pre-existing drying section in a trouble-free manner. The device can be used in the most simple manner in renovated facilities as well as in newly constructed facilities.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 Separating and transfer device
12 Leader strip
14 Drying cylinder
16 Separating device
18 Air transfer device
20 Rope shears
20' Inner rope
20" Outer rope
22 Plate
24 Doctor bar
26 Doctor
28 Air nozzles
30 Air guide panel
32 Separating region
34 Air blast pipe
36 Separating element
38 Separating element
40 Frame part
42 Frame part
44 Pivot axis
46 Set screw
48 Set screw
L Strip travel direction
F Arrow

What is claimed:

1. An apparatus for separating and transferring a leader strip to be threaded into a machine for at least one of producing and treating a material web, comprising:

a separating device positioned to perform a separation process;

a transfer device positioned to change a feed path of the leader strip after the separation process to transfer the leader strip to a subsequent device of the machine after the separation process; and a common plate positioned to guide the transfer strip prior to the separation process, wherein said transfer device is positioned upstream, relative to a strip travel direction, from said separating device.

2. The apparatus in accordance with claim 1, wherein said separating device and said transfer device are coupled to said common plate.

3. The apparatus in accordance with claim 2, further comprising at least one device arranged to pre-stress the leader strip prior to the separation process, wherein said separation process includes separating the leader strip to form an end to be transferred to the subsequent device, and wherein the material web is one of a paper and a cardboard web.

4. The apparatus in accordance with claim 3, wherein said pre-stress device is positioned downstream of said transfer device.

5. The apparatus in accordance with claim 3, wherein said pre-stress device is positioned downstream of said separating device.

6. The apparatus in accordance with claim 1, further comprising a doctor bar, wherein said common plate is firmly attached to a doctor bar.

7. The apparatus in accordance with claim 1, wherein said transfer device comprises an air transfer device.

8. The apparatus in accordance with claim 1, wherein said transfer device includes at least one positionably adjustable nozzle, and wherein, prior to the separation process, said at least one nozzle is positionable to direct a jet of air at least essentially tangentially to said common plate, thereby stabilizing the leader strip for separation.

9. The apparatus in accordance with claim 1, wherein said transfer device includes at least one positionably adjustable nozzle, and wherein, prior to the separation process, said at least one nozzle is positionable to direct a jet of air substantially along a leader strip carrying surface of said common plate, thereby stabilizing the leader strip for separation.

10. The apparatus in accordance with claim 1, further comprising at least one air guide panel positioned downstream from said separating device and on a leader strip facing surface of said common plate, wherein said at least one air guide panel is arranged to pre-stress the leader strip prior to the separation process.

11. The apparatus in accordance with claim 10, wherein said at least one air guide panel is arranged to lift the leader strip off of said leader strip facing surface of said common plate, whereby the leader strip is guided through a separating region of said separating device.

12. The apparatus in accordance with claim 10, wherein said at least one air guide panel comprises at least two air guide panels positioned one behind the other in the strip travel direction.

13. The apparatus in accordance with claim 1, wherein said transfer device comprises an air transfer device including several air nozzles.

14. The apparatus in accordance with claim 13, wherein said air nozzles are adjustable and moveable.

15. The apparatus in accordance with claim 1, wherein said transfer device comprises an air blast pipe with at least one row of air nozzles extending parallel to a tube axis.

16. The apparatus in accordance with claim 15, wherein at least a portion of said air nozzles is adjustable and moveable relative to said air blast pipe.

17. The apparatus in accordance with claim 15, wherein said air blast pipe is adjustable and rotatable around said tube axis.

18. The apparatus in accordance with claim 1, wherein said transfer device comprises an air transfer device with positionably adjustable air nozzles, and wherein said adjustable air nozzles are positionably adjustable to direct a jet of blown to at least one of stabilize and pre-stress the leader strip.

19. The apparatus in accordance with claim 1, wherein said separating device is arranged to produce at least one of a scissors cut and a parallel cut.

20. The apparatus in accordance with claim 1, wherein said separating device comprises at least two separating elements which are movable relative to each other.

21. The apparatus in accordance with claim 20, wherein said at least two separating elements are knife-like elements.

22. The apparatus in accordance with claim 21, wherein said at least two separating elements are adjustably mounted on two frame parts that are movable relative to one another.

23. The apparatus in accordance with claim 22, wherein said two frame parts are pivotably coupled to one another.

24. The apparatus in accordance with claim 22, wherein said separating elements are adjustably attached to said frame parts by set screws.

25. The apparatus in accordance with claim 1, wherein said separating device comprises separating elements which are at least partially constructed of smooth cutting elements.

26. The apparatus in accordance with claim 1, wherein said separating device comprises separating elements which are at least partially constructed of at least one of perforated and toothed cutting elements.

27. The apparatus in accordance with claim 1, wherein said transfer device includes at least one positionably adjustable nozzle, and wherein, prior to the separation process, said at least one nozzle is positionable to direct a jet of air to create a low pressure between said common plate and said leader strip, whereby said leader strip is guided against said common plate.

28. The apparatus in accordance with claim 1, further comprising a doctor located adjacent an element of the machine and positioned to remove the leader strip from said element.

29. The apparatus in accordance with claim 28, wherein a surface of said doctor facing the leader strip is arranged to be substantially coplanar with said common plate.

30. The apparatus in accordance with claim 1, wherein said change of feed path of the leader strip comprises moving the leader strip laterally to a feed path direction of the leader strip prior to separation.

31. A process for separating and transferring a leader strip to be threaded into a machine for at least one of producing and treating a material web, comprising:

guiding a transfer strip over a common plate;

separating the transfer strip with a separating device;

changing a feed path of the transfer strip after the separating to transfer the transfer strip to a subsequent device of the machine with a transfer device, wherein the transfer device is positioned upstream, relative to a strip travel direction, from the separating device.

32. The process in accordance with claim 31, wherein the separating device and the transfer device are coupled to the common plate.

33. The process in accordance with claim 32, further comprising pre-stressing the leader strip prior to separating, wherein the separating occurs downstream of the transfer device.

34. The process in accordance with claim 32, further comprising pre-stressing the leader strip prior to separating, wherein the pre-stressing occurs downstream of the separating device.

35. The process in accordance with claim 31, further comprising directing a jet of air at least tangentially to the common plate, thereby stabilizing the leader strip for separation.

36. The process in accordance with claim 31, further comprising directing a jet of air substantially along a leader strip carrying surface of the common plate, thereby stabilizing the leader strip for separation.

37. The process in accordance with claim 31, further comprising pre-stressing the leader strip prior to separating by directing an air jet obliquely to the strip travel direction.

38. The process in accordance with claim 31, further comprising directing an air jet to press the leader strip against the common plate via the Coanda effect.

39. The process in accordance with claim 31, wherein the changing of path comprises moving the transfer strip laterally to a feed path direction of the transfer strip prior to separation.

40. An apparatus for separating and transferring a leader strip to be threaded into a machine for at least one of producing and treating a material web, comprising:

a separating device positioned to perform a separation process;

a transfer device comprising at least one directionally adjustable air nozzle positionable to transfer the leader strip to a subsequent device of the machine after the separation process; and a common plate positioned to guide the transfer strip prior to the separation process, wherein said transfer device is positioned upstream, relative to a strip travel direction, from said separating device.

41. A process for separating and transferring a leader strip to be threaded into a machine for at least one of producing and treating a material web, comprising:

guiding a transfer strip over a common plate;

separating the transfer strip with a separating device;

transferring the transfer strip to a subsequent device of the machine after the separating with a directionally adjustable air nozzle of a transfer device, wherein the transfer device is positioned upstream, relative to a strip travel direction, from the separating device.

* * * * *